US009661938B2

(12) United States Patent
Hung et al.

(10) Patent No.: US 9,661,938 B2
(45) Date of Patent: May 30, 2017

(54) FOLDABLE FRAME ASSEMBLY FOR A PLAYPEN

(71) Applicant: LERADO (ZHONG SHAN) INDUSTRIAL CO., LTD., Zhong Shan, Guang Dong Province (CN)

(72) Inventors: Sheng-Po Hung, Chuayi (TW); Yu-Wen Wang, Chiayi (TW); Chen-Tai Chang, Chiayi County (TW)

(73) Assignee: Dorel Juvenile (Zhongshan) Product Co., Ltd., Guang Dong (CN)

( * ) Notice: Subject to any disclaimer, the term of this patent is extended or adjusted under 35 U.S.C. 154(b) by 0 days.

(21) Appl. No.: 14/668,661

(22) Filed: Mar. 25, 2015

(65) Prior Publication Data

US 2015/0272343 A1 Oct. 1, 2015

(30) Foreign Application Priority Data

Mar. 25, 2014 (CN) ..... 2014 2 0136229 U

(51) Int. Cl.
*A47D 13/06* (2006.01)

(52) U.S. Cl.
CPC ..... *A47D 13/061* (2013.01); *A47D 13/063* (2013.01)

(58) Field of Classification Search
CPC .... A47D 13/06; A47D 13/061; A47D 13/063; A47D 13/065; A47D 13/066; A47D 13/068; A47B 3/10; A47B 3/002; A47C 5/10; A47C 17/76
See application file for complete search history.

(56) References Cited

U.S. PATENT DOCUMENTS 4,008,499 A * 2/1977 Wren, Jr. ..... A47D 13/063 5/99.1
4,739,527 A * 4/1988 Kohus ..... A47D 13/066 5/99.1
5,761,754 A * 6/1998 Cheng ..... A47D 13/063 5/98.1
6,317,907 B1 * 11/2001 Wang ..... A47D 13/063 5/93.1
6,336,234 B1 * 1/2002 Kuo ..... A47D 13/063 5/93.1
6,929,230 B2 * 8/2005 Tsai ..... B65F 1/1468 108/67
9,155,402 B1 * 10/2015 Whitman ..... A47D 7/002
(Continued)

*Primary Examiner* — Nicholas Polito
*Assistant Examiner* — Amanda L Miller
(74) *Attorney, Agent, or Firm* — Muncy, Geissler, Olds & Lowe, P.C.

(57) ABSTRACT

A foldable frame assembly for a playpen includes a collapsible bottom frame which has a central support mount, a plurality of linking elements, a plurality of first linking rods and a plurality of second linking rods. The linking elements are pivoted between the central support mount and the lower end of the plurality of pillars respectively. Each of the linking elements is provided with a sliding part for moving along the linking elements. When the central support mount was lifted upward, the second linking rods are associated with the first linking rods through the sliding parts thereby incurring an inward torque to prevent the pillars from deflecting outward. By such of the inward torque, users can save their troublesome of stretching hands to hold and keep the pillars uprightly while converting the playpen into its folded configuration.

8 Claims, 5 Drawing Sheets

(56) References Cited

U.S. PATENT DOCUMENTS

| | | | | |
|---|---|---|---|---|
| 2008/0189854 | A1* | 8/2008 | Thorne | A47D 13/063 5/99.1 |
| 2008/0196163 | A1* | 8/2008 | Thorne | A47D 13/063 5/99.1 |
| 2016/0000234 | A1* | 1/2016 | Whitman | A47D 13/063 5/99.1 |

* cited by examiner

FOLDABLE FRAME ASSEMBLY FOR A PLAYPEN

BACKGROUND OF THE INVENTION

Field of the Invention

The present invention relates to a foldable frame assembly for a playpen, especially to a foldable frame assembly which can produce an inward torque to the pillars of the playpen while in a folding process.

Description of the Related Art

Normally, playpen is used to provide infants and children with safe space for playing and sleeping inside. As a regular playpen should be made big enough for providing a comfortable space, it would occupy a lot of space in house. To save the shipping cost and facilitate easy storage, the playpen is normally provided with a foldable frame assembly for permitting users to erect it in a use position and fold it into a folded compact position is an easy way.

The foldable frame assembly may include a plurality of pillars, an upper collapsible frame pivoted to each upper end of the plurality of pillars, and a collapsible bottom frame pivoted to each lower end of the plurality of pillars.

When folding the playpen, the collapsible bottom frame shall be unlocked so as to pull the pillars inward and make them close to each other. As the collapsible bottom frame is pivoted with the plurality of pillars with merely a regular pivot mounts, when the lower end of the pillars are pulled by the collapsible bottom frame to move inward, the pillars shall tend to incline outward, therefore the users are forced to stretch their hands to stop the pillars from deflecting outward randomly.

SUMMARY OF THE INVENTION

For saving the troublesome of stretching the hand to stop the pillars from deflecting outward randomly, the present invention provides a foldable frame assembly for a playpen which comprises at least a plurality of pillars, an upper collapsible frame pivoted to each upper end of the plurality of pillars, and a collapsible bottom frame pivoted to each lower end of the plurality of pillars.

The foldable frame assembly can be kept in a use configuration by locking the collapsible bottom frame, and can be converted to a folded configuration by unlocking the collapsible bottom frame.

The features of the foldable frame assembly of the present invention includes the collapsible bottom frame which has a central support mount, a plurality of linking elements, a plurality of first linking rods and a plurality of second linking rods. When the foldable frame assembly has been converted to the use configuration, the central support mount is used to contact ground for supporting the collapsible bottom frame in horizontal plane. The linking elements are pivoted between the central support mount and the lower end of the plurality of pillars respectively. Each of the linking elements is provided with a sliding part for moving along the linking elements.

When the central support mount was lifted to move upward, the second linking rods are associated with the first linking rods through the sliding parts thereby incurring an inward torque to prevent the pillars from deflecting outward. By the aforementioned assembly of the present invention, the inward torque shall save the troublesome of stretching hands to hold the pillars uprightly.

BRIEF DESCRIPTION OF THE DRAWINGS

The accompanying drawings, which are included to provide a further understanding of the invention are incorporated in and constitute a part of this specification, illustrate embodiments of the invention and together with the description serve to explain the principles of the invention. In the drawings.

DETAILED DESCRIPTION OF THE PREFERRED EMBODIMENTS

Figure 1:
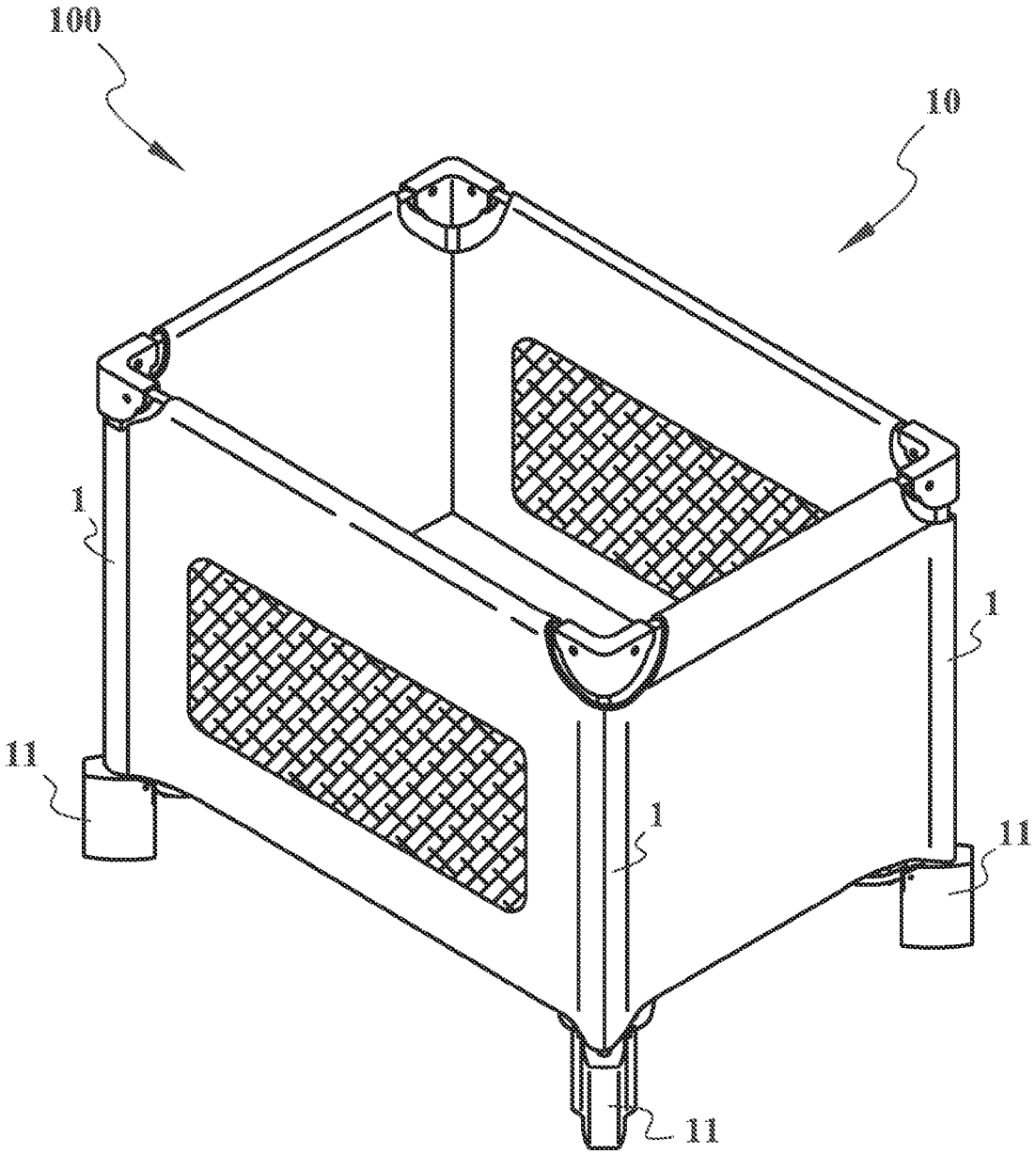
FIG. 1 is a perspective view of an embodiment of the foldable frame assembly according to the present invention on which covered with a fabric envelope.
Figure 2:
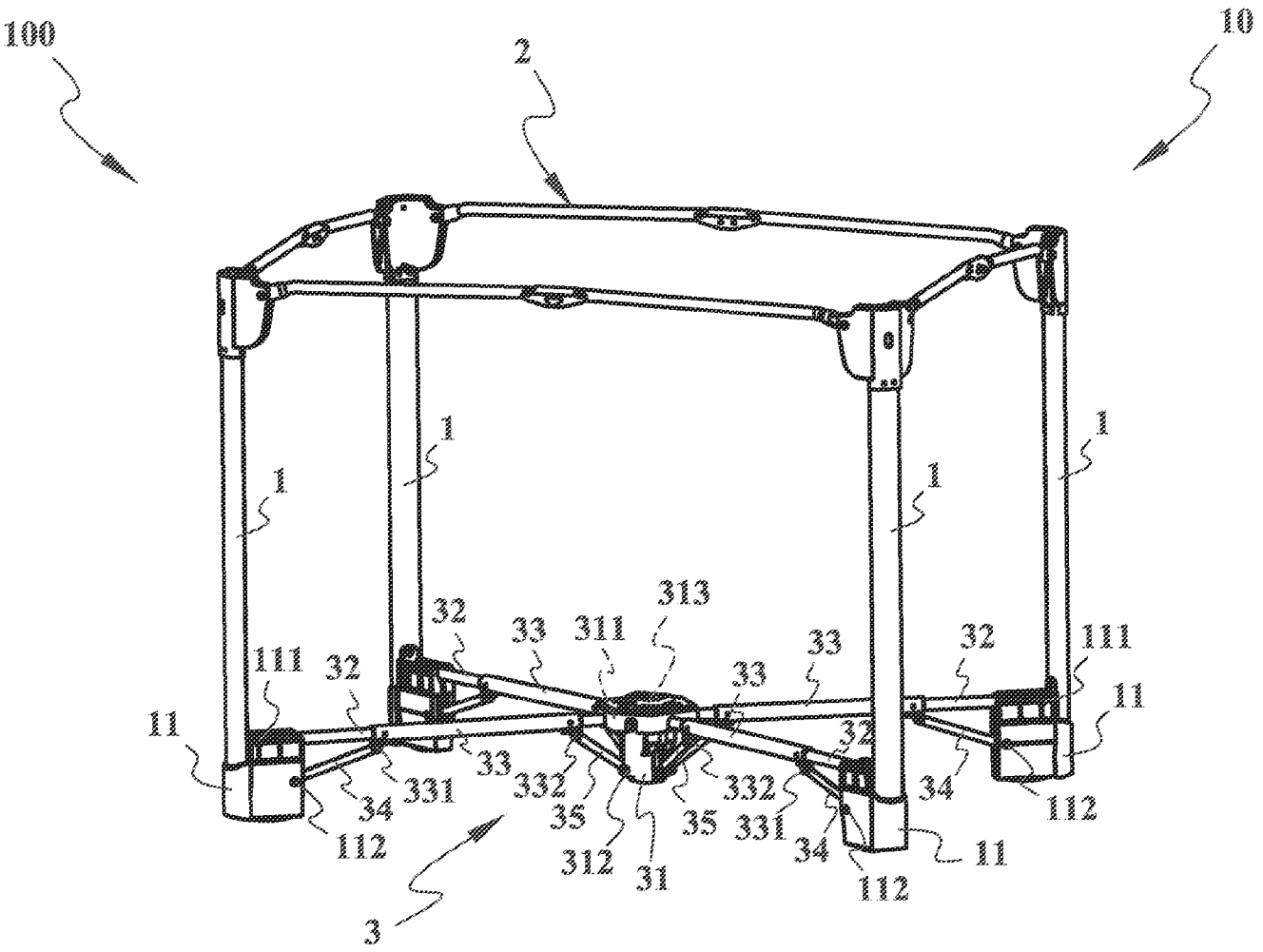
FIG. 2 is schematic perspective view for showing the foldable frame assembly kept in a use configuration.

Referring to FIGS. 1 and 2, an embodiment of a foldable frame assembly for a playpen 10 according to the present invention, comprises at least a plurality of pillars 1, an upper collapsible frame 2 pivoted to each upper end of the plurality of pillars 1, and a collapsible bottom frame 3 pivoted to each lower end of the plurality of pillars 1. The foldable frame assembly 10 can be kept in a use configuration 100 by locking the collapsible bottom frame 3, and can be converted to a folded configuration 200 by unlocking the collapsible bottom frame 3.

The collapsible bottom frame 3 may include a central support mount 31, a plurality of linking elements 32, a plurality of first linking rods 34 and a plurality of second linking rods 35. When the foldable frame assembly 10 has been converted to the use configuration 100, the central support mount 31 contacts ground for supporting the collapsible bottom frame 3 in horizontal plane.

The linking elements 32 are pivoted between the central support mount 31 and the lower end of the plurality of pillars 1 respectively. Each of the linking elements 32 is provided with a sliding part 33 for moving along the linking elements 32. Preferably, the sliding parts 33 may be provided with a first tab 331 for pivoting with one of the first linking rods 34, and a second tab 332 for pivoting with one of the second linking rods 35 respectively.

The first linking rods 34 are pivoted between the sliding parts 33 and lower end of the plurality of pillars 1 respectively. The plurality of second linking rods 35 are pivoted between the sliding parts 33 and the central support mount 31.

Figure 4:
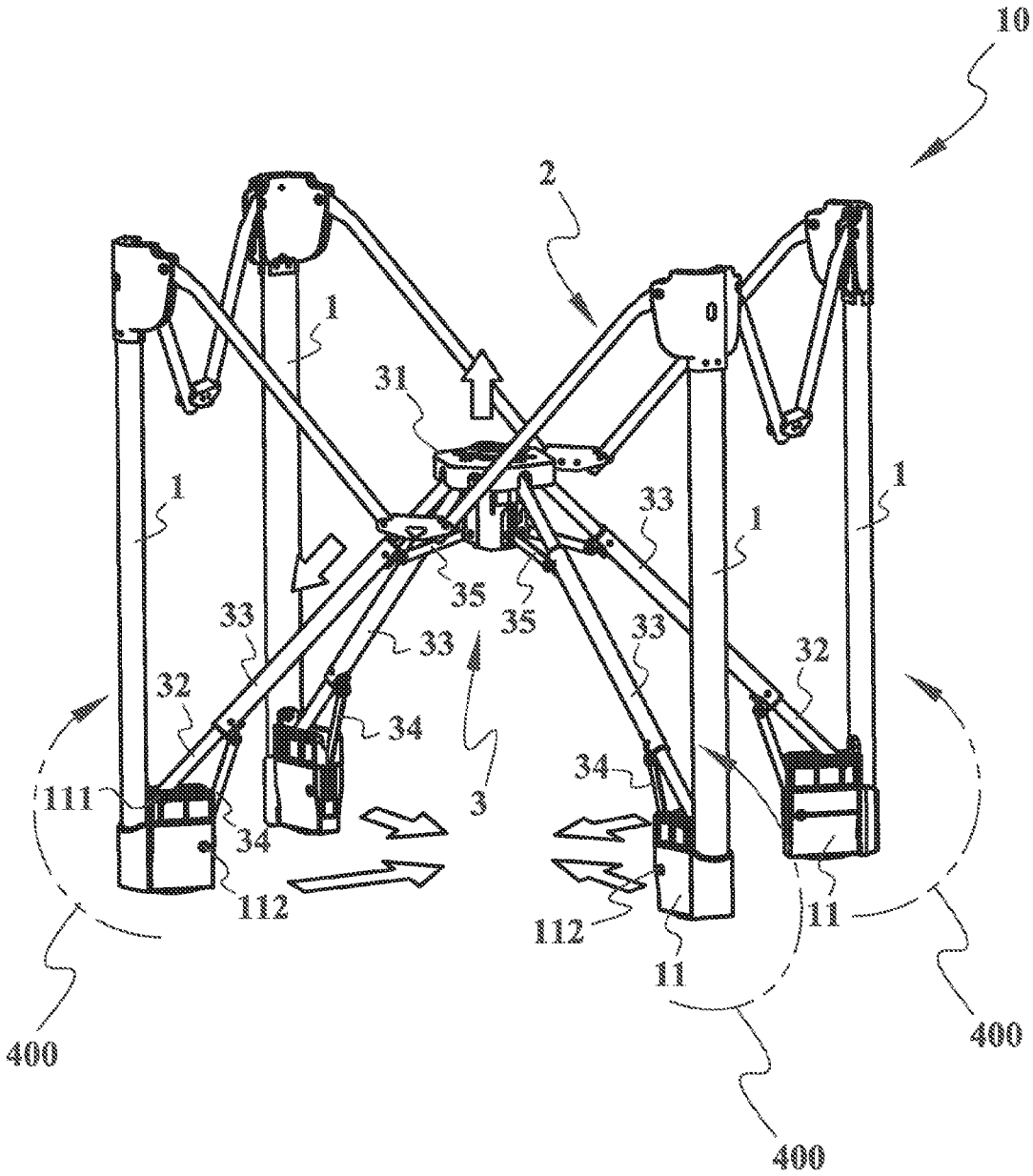
FIG. 4 is a schematic view for showing the converting of the foldable frame assembly from the use configuration to a folded configuration.
Figure 5:
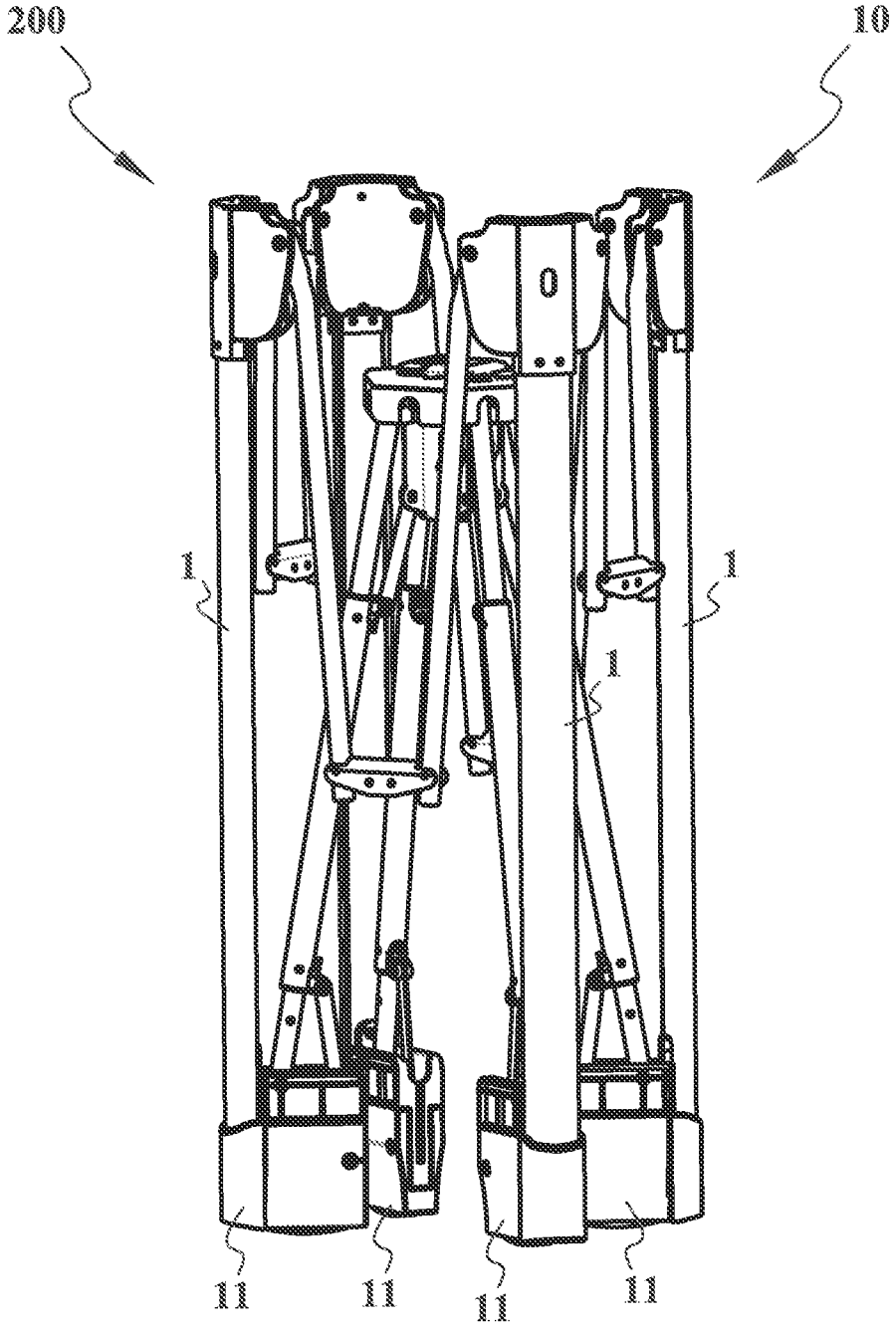
FIG. 5 is a schematic view for showing the foldable frame assembly in a use configuration.

Referring to FIG. 4, by the aforementioned assembly, when users need to fold the playpen 10, they may unlock the collapsible bottom frame 3 and then hold and lift the central support mount 31 so as to carry the linking elements 32 to follow and rotate upward. When the linking elements 32 are following the central support mount 31 and rotating upward, they would drive the pillars 1 to move inward and close to each other; in the meantime, the second linking rods 35 would push the sliding parts 33 and drive the first linking rods 34 toward the respective lower end of the pillars 1, this would incur an inward torque 400 to the pillars 1. By effecting the inward torque 400, the pillars 1 can be prevented from deflecting outward while the playpen 10 is converting from the use configuration 100 to the folded configuration 200.

For pivoting the lower end of the pillars 1 with the linking elements 32 and the first linking rods 34 respectively, preferably, the lower end of the pillars 1 each may be provided with a lower pivot mount 11. The lower pivot mount 11 is provided with a first pivot portion 111 for pivoting with one of the linking elements 32, and a second pivot portion 112 for pivoting with one of the first linking rods 34. Beside of that, the central support mount 31 may further be provided with a plurality of third pivot portions 311 for pivoting with the linking elements 32 respectively, and a fourth pivot portions 312 for pivoting with the second linking rods 35 respectively.

In order to lock the collapsible bottom frame 3 in the aforementioned use configuration 100, the central support mount 31 may be provided with a locking mechanism 313 for locking the linking elements 32 into a non-rotatable position thereby locking the collapsible bottom frame 3. When locking mechanism 313 has been unlocked, the user may then lift the central support mount 31 to pull the pillars 1 to each other by the rotation of linking elements 32, so as to convert the playpen 10 into the aforementioned folded configuration 200.

Figure 3:
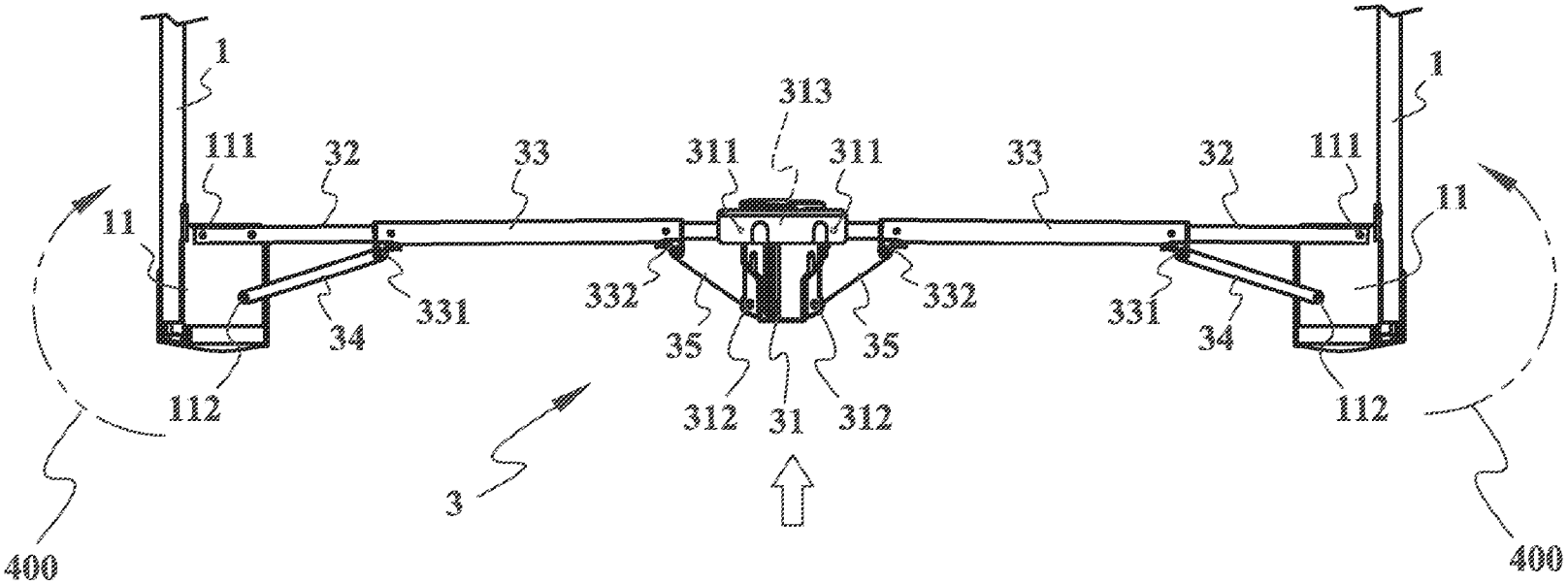
FIG. 3 is a side view for showing a collapsible bottom frame of the foldable frame.

Referring to FIGS. 3 and 4, the aforementioned inward torque 400 is applied on the first pivot portion 111 of the lower pivot mounts 11. When the central support mount 31 was lifted to move upward, the second linking rods 35 are associated with the first linking rods 34 through the sliding parts 33, so as to incur the inward torque 400 to prevent the pillars 1 from deflecting outward.

By the aforementioned assembly of the present invention, an inward torque 400 shall be produced to keep the pillars 1 always in an upright position while folding the playpen 10, this would save the troublesome for the users of stretching their hands to hold the pillars 1 uprightly.

While particular embodiments of the invention have been described, those skilled in the art will recognize that many modifications are possible that will achieve the same goals by substantially the same system, device or method, and where those systems, devices or methods still fall within the true spirit and scope of the invention disclosed.

What is claimed is:

1. A foldable frame assembly for a playpen, comprising a plurality of pillars, an upper collapsible frame pivoted to an upper end of each of the plurality of pillars and a collapsible bottom frame pivoted to a lower end of each of the plurality of pillars; the foldable frame assembly can be kept in a use configuration by locking the collapsible bottom frame, and can be converted to a folded configuration by unlocking the collapsible bottom frame; and wherein said collapsible bottom frame comprises:

a central support mount for contacting a ground surface when the foldable frame assembly is in the use configuration;

a plurality of linking elements, each of the plurality of linking elements having a first end pivotally connected to the central support mount and a second end pivotally connected to the lower end of one of the plurality of pillars respectively;

a plurality of sliding parts slidingly mounted on the plurality of linking elements respectively and each of the sliding parts including a tubular body having a first end and a second end movable along the plurality of linking elements respectively;

a plurality of first linking rods, each of the plurality of first linking rods having a first end pivotally attached to the lower end of one of the plurality of pillars and a second end pivotally attached to the first end of one of the plurality of sliding parts respectively for pivoting between the plurality of sliding parts and the lower end of each of the plurality of pillars respectively; and a plurality of second linking rods, each of the plurality of second linking rods having a first end pivotally attached to the second end of one of the plurality of sliding parts and a second end pivotally attached to the central support mount for pivoting between the plurality of sliding parts and the central support mount respectively.

2. The foldable frame assembly for a playpen of claim 1, wherein the lower end of each of the plurality of pillars has a lower pivot mount, the plurality of linking elements and the plurality of first linking rods respectively pivoting with respect to the pivot mount.

3. The foldable frame assembly for a playpen of claim 2, wherein the lower pivot mount is provided with a first pivot portion, wherein one of the plurality of linking elements pivots with respect to the first pivot portion, and a second pivot portion wherein one of the plurality of first linking rods pivots with respect to the second pivot portion.

4. The foldable frame assembly for a playpen of claim 1, wherein the central support mount is provided with a plurality of third pivot portions, the plurality of linking elements respectively pivoting with respect to the plurality of third pivot portions, and a plurality of fourth pivot portions, the plurality of second linking rods respectively pivoting with respect to the plurality of fourth pivot portions.

5. The foldable frame assembly for a playpen of claim 1, wherein each of the sliding parts is provided with a first tab for pivoting with one of the plurality of first linking rods, and a second tab for pivoting with one of the plurality of second linking rods respectively.

6. The foldable frame assembly for a playpen of claim 3, wherein the central support mount is associated with the plurality of pillars by the plurality of sliding parts and the plurality of first linking rods thereby incurring an inward torque on each of the plurality of pillars respectively by lifting the central support mount, so as to prevent the plurality of pillars from deflecting outward while the playpen is converting to the folded configuration.

7. The foldable frame assembly for a playpen of claim 1, wherein the central support mount includes a locking mechanism for locking the plurality of linking elements thereby locking the collapsible bottom frame.

8. The foldable frame assembly for a playpen of claim 7, wherein the central support mount can be lifted upward after the locking mechanism is unlocked so as to carry the plurality of pillars inward toward a center of the playpen for converting the playpen to the folded configuration.

* * * * *